US006957517B2

(12) United States Patent
Auriemma

(10) Patent No.: US 6,957,517 B2
(45) Date of Patent: Oct. 25, 2005

(54) SPLICE PLATE FOR FACETED RADIUS GRID

(75) Inventor: Joseph Auriemma, Jeffersonville, PA (US)

(73) Assignee: Worthington Armstrong Venture, Malvern, PA (US)

( * ) Notice: Subject to any disclaimer, the term of this patent is extended or adjusted under 35 U.S.C. 154(b) by 67 days.

(21) Appl. No.: 10/632,724

(22) Filed: Aug. 1, 2003

(65) Prior Publication Data

US 2005/0034412 A1 Feb. 17, 2005

(51) Int. Cl.[7] ..... E04B 2/00; E04B 5/00; E04B 9/00

(52) U.S. Cl. ..... 52/506.07; 52/506.06; 52/506.08; 52/731.7; 52/733.1

(58) Field of Search ..... 52/506.07, 506.06, 52/506.08, 731.7, 733.1

(56) References Cited

U.S. PATENT DOCUMENTS

| | | | | |
|---|---|---|---|---|
| 4,128,978 A | * | 12/1978 | Beynon | 52/232 |
| 4,783,946 A | * | 11/1988 | Boegle | 52/733.1 |
| 4,932,170 A | | 6/1990 | Spear | |
| RE33,501 E | * | 12/1990 | Platt et al. | 52/664 |
| 5,347,783 A | * | 9/1994 | Frecska et al. | 52/506.07 |
| 5,349,803 A | * | 9/1994 | Nute, Jr. | 52/573.1 |
| 6,047,512 A | | 4/2000 | Wendt et al. | |
| 6,178,712 B1 | | 1/2001 | Sauer | |
| 6,351,919 B1 | * | 3/2002 | Lin et al. | 52/506.07 |
| 6,374,564 B1 | * | 4/2002 | Fletterick et al. | 52/506.07 |
| 6,751,922 B1 | * | 6/2004 | Auriemma | 52/733.1 |

OTHER PUBLICATIONS

Armstrong Drywall Furring System Detail—Typ. Vaulted Ceiling; DW-20-02, 1 page.
Armstrong Drywall Furring System Detail/Furring Channel; DW-20-03, 1 page.
Armstrong Drywall Barrel Vault in Carousel Court; DW-23, 1 page.
Armstrong Drywall Barrel Vault in Carousel Court; DW-23-01, 1 page.
Armstrong Drywall Furring System Detail—Typ. Vaulted Ceiling; DW-20-01, 1 page.
Convex/Concave Radius Installation Steps, 1 page.
Four photographs (4 pages).

* cited by examiner

*Primary Examiner*—Naoko Slack
*Assistant Examiner*—Chi Q. Nguyen
(74) *Attorney, Agent, or Firm*—Eugene Chovanes

(57) ABSTRACT

A splice plate for a faceted curved beam formed in the field from a straight beam. The splice plate can be used to fix the bends of either a convex or a concave curved beam used in the grid of a curved suspended drywall ceiling so that the cross beams in the grid are positioned in contact with the curved drywall board of the ceiling.

2 Claims, 3 Drawing Sheets

SPLICE PLATE FOR FACETED RADIUS GRID

BACKGROUND OF THE INVENTION

1. Field of the Invention

The present invention relates to a curved suspended ceiling having a grid of inverted T beams suspended from a structural ceiling, with drywall boards fastened to the grid.

2. Description of the Prior Art

Suspended ceilings in rooms are common. They have a grid of metallic beams that is suspended from an overhead structural ceiling, as by wires.

The metallic beams used in the grids of suspended ceilings are made in a continuous process. A continuous strip of metal, usually steel, fed off a reel, is passed through a series of rolls that form the metal into an inverted T cross section having a web, a bulb at the top of the web, and horizontal flanges extending from the bottom of the web. Such beam construction is well-known.

A straight, finished beam continuously emerges from the roll forming operation, and is cut, on the run, into suitable lengths, of, for instance, 12 feet, or 4 feet, or 2 feet, with, for instance, a flying shear. Connectors are then formed at the ends of the straight beam lengths. The beams are then stacked and packaged for shipment to the job site for assembly into the grid of a suspended ceiling. The beam cross section gives the beam rigidity throughout these operations.

The beams are formed into a grid at the job site, in the well-known prior art manner, by means of the connectors at the ends of the beam. Such grid has parallel main beams that are connected by cross beams.

In a panel suspended ceiling, panels are laid in the grid openings and supported by the flanges of the beams. In a drywall suspended ceiling, drywall boards are attached to the beams of the grid by screws.

Both types of ceilings described above virtually always extend in a horizontal plane.

Occasionally, suspended ceilings that are curved are installed, particularly of the drywall type. In a curved drywall suspended ceiling, a grid of curved main beams, connected by straight cross beams, is suspended by wires from a structural ceiling, and drywall boards are then attached to the grid by screws, as in a horizontal drywall suspended ceiling. The faces of the drywall boards are wetted and then are bent to the desired shape prior to attachment to the grid.

There are various prior art ways of forming a curved main beam for use in the grid of a curved drywall ceiling.

In U.S. Pat. No. 6,751,922 issued Jun. 22, 2004, for FACETED RADIUS GRID, incorporated herein by reference, the prior art is discussed, and there is disclosed an improved curved main beam, wherein straight, inverted T beams are continuously roll formed from strip metal, at the factory, in the usual prior art way.

Such beams are of inverted T cross section with a bulb at the top, a downward extending vertical web, and horizontal flanges extending from the bottom of the web. The two layers of the web are continuously stitched together. Cutouts in the beam, at spaced intervals along the beam, are made continuously and contemporaneously with the roll forming operations, in a portion of the web and a bulb. A segment of the bulb is left in place above the cutout to maintain the integrity of the straight beam. The cutouts are manually extended through the remaining segment of the bulb at the job site with a minimum of cutting and no need for measuring, and the beam is bent to the required radius, at the cutouts, between facets. Splice plates are applied over the extended cutouts at the bend to fix the beam at the desired faceted curve.

Drywall boards are then attached, from underneath the ceiling, to the beam flanges, as by self-tapping screws. In applying the drywall to the grid, the faces of the drywall boards are wetted, and then are curved to the desired shape to conform to the faceted grid, prior to attachment to the grid.

SUMMARY OF THE PRESENT INVENTION

The present invention is for an improved splice plate in the curved beam disclosed in the '850 application.

The splice plate of the invention can be used in both a convex curved and a concave curved main beam by merely inverting the plate.

In a convex ceiling, the plate permits cross beams in the grid to be connected through a slot in the plate. This positions the cross beams at the apexes of the faceted curves of the main beams. The curved drywall contacts the ceiling grid at the apexes, and at the cross beams, to which the curved drywall can be attached by self-tapping screws in the well-known prior art manner. This was not possible with the grid of the '850 application, since the cross beams were connected to the curved main beams away from the apexes, where the curved drywall did not contact the cross beams.

In a concave curved ceiling, the concave curved main beams of the present invention can be suspended from the structural ceiling at the splice plates, and again, as in the convex curved ceiling, the curved drywall can be screwed directly into the cross beams at their points of contact between the drywall and the cross beams. In the case of the concave curved ceiling, the cross beams extend between the curved main beams at points midway along the chords of the faceted beams. It is at these points that the curved drywall contacts the ceiling grid.

DESCRIPTION OF THE PREFERRED EMBODIMENT

Figure 1:
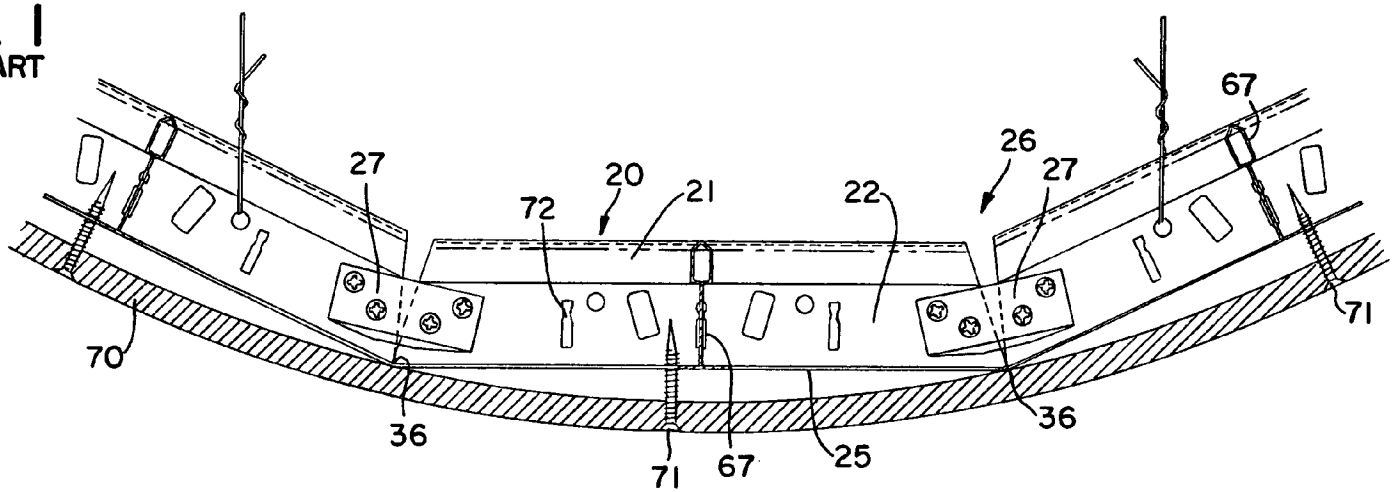
FIG. 1 PRIOR ART
FIG. 1 is a side elevational view of the prior art beam disclosed in the '850 application, bent in a convex curve, with prior art splice plates attached.

In making convex curved main beam 37, or a concave curved main beam 39, there is first formed a straight beam 20 of inverted T cross section having a bulb 21, web 22, and horizontal flanges 23 and 25, as disclosed in the '850 patent application. Roll forming of a straight beam 20 is well-known in the prior art.

As the straight, finished beam 20 continuously emerges from the roll forming operation, it is continuously cut into suitable lengths, for instance 12 feet, or 4 feet, or 2 feet, as with a flying shear. Connectors, well-known in the art, are formed on the ends of the straight beams 20. The beams 20 are then stacked and packaged for shipment to the job site for assembly into the grid of a suspended ceiling.

Figures 2, 3, 4:
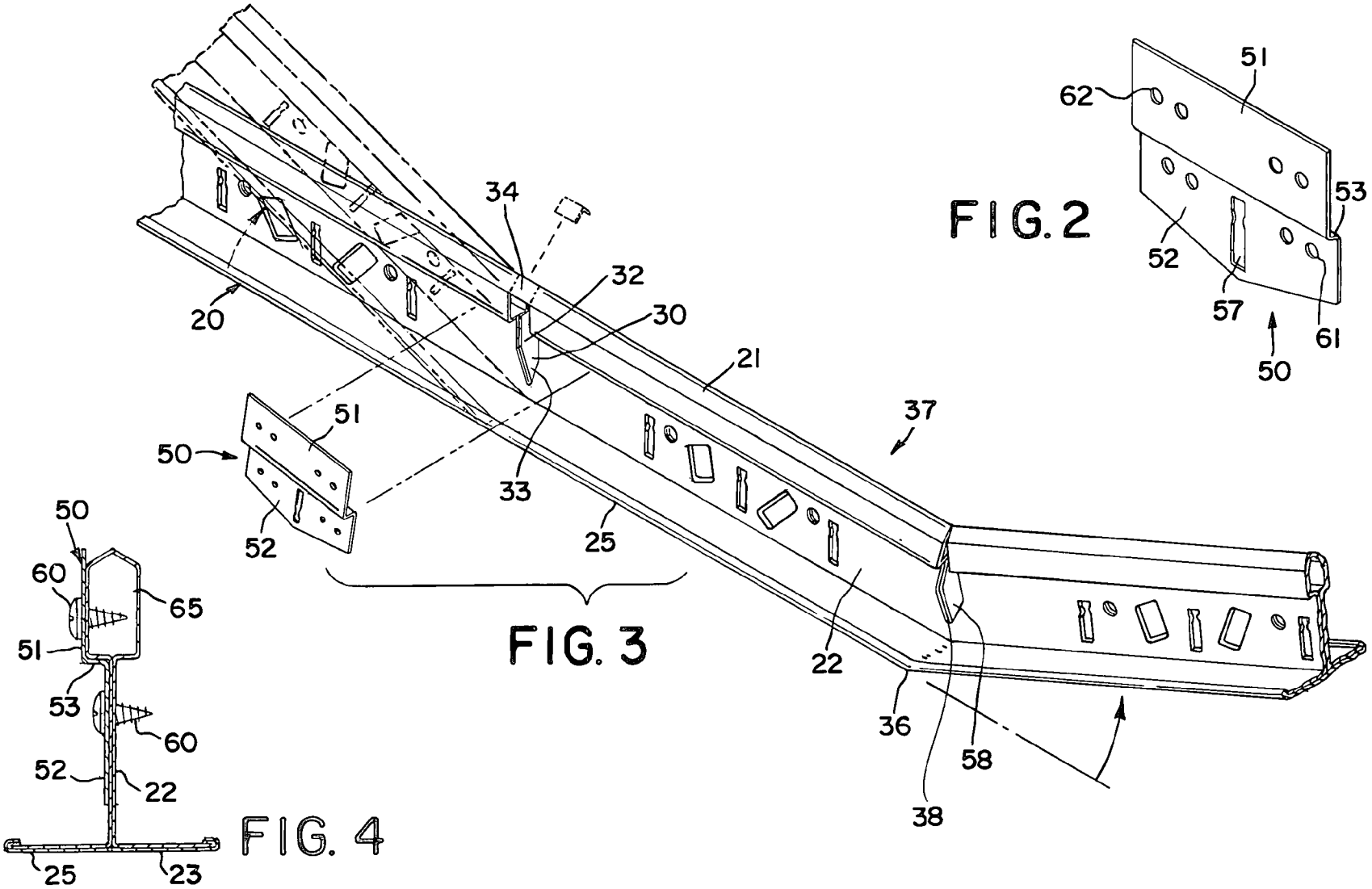
FIG. 2 is a perspective view of the splice plate of the present invention.
FIG. 3 is a perspective view, partly in phantom, of a beam partially bent into a convex curve, with the beam about to be further bent, and a splice plate of the invention about to be attached.
FIG. 4 is a cross sectional view of the splice plate of the invention in place on a beam bent in a convex curve, as shown, for instance, in FIG. 3.

Cutouts 30, as seen in FIG. 3, are continuously formed in the straight beam 20 as the straight beam 20 is continuously being roll formed in the roll forming operation, as disclosed in the '850 application, before the continuous beam is cut into lengths.

The cutout 30 itself, as seen particularly in FIG. 3 of the present drawings, is generally a vertically disposed rectangle 32 with a V shaped bottom 33. The cutout 30 leaves a segment 34 of the bulb 21, which is selectively cut out at the job site as will be described, and a web portion at the bottom of the cutout 30, in place in the straight beam 20, to provide rigidity to the beam 20 at the cutout 30.

By means of the bulb segment 34, and the remaining web portion, the beam 20 maintains its rigidity for handling, including cutting the continuous beam 20 into lengths, as described above, forming connectors at the ends, packaging, shipping to the job site, and handling at the site.

The beam 20 with the cutouts 30, before being formed into a curved beam 37 or 39, is also of sufficient rigidity to be used as a straight beam where needed.

The cutout 30 can have representative dimensions of 0.625 inches in width and 1.337 inches in height, in a beam having an overall height of 1.696 inches, as shown in FIGS. 3 and 4.

Figure 5:
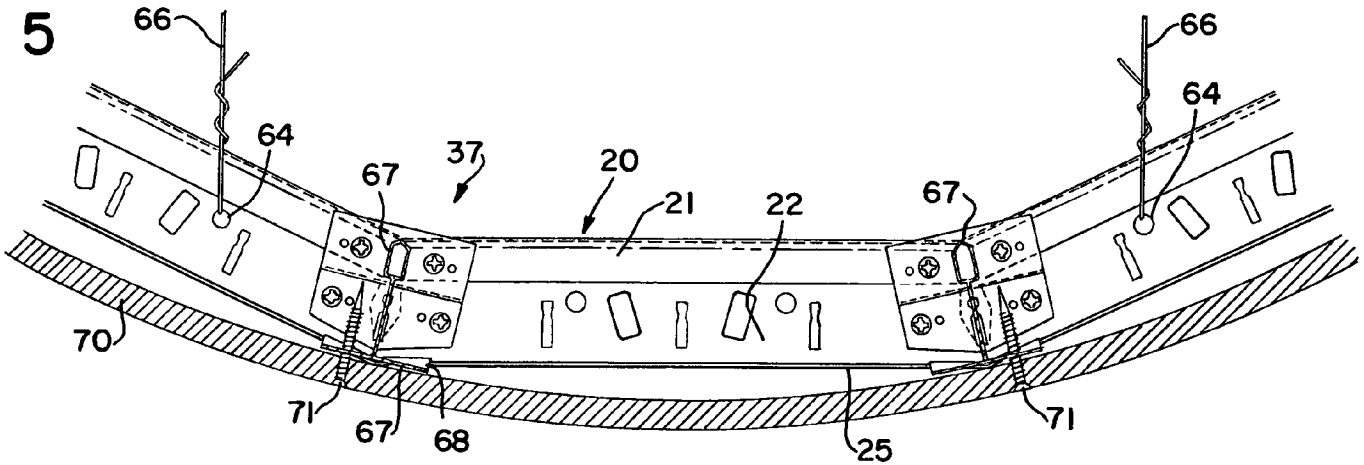
FIG. 5 is a view similar to FIG. 1 showing splice plates of the invention in place on a convex curved beam, with cross beams connected through the splice plate to a curved main beam to form a curved grid, and curved drywall attached to the grid at the cross beams, by self-tapping screws.
Figure 7:
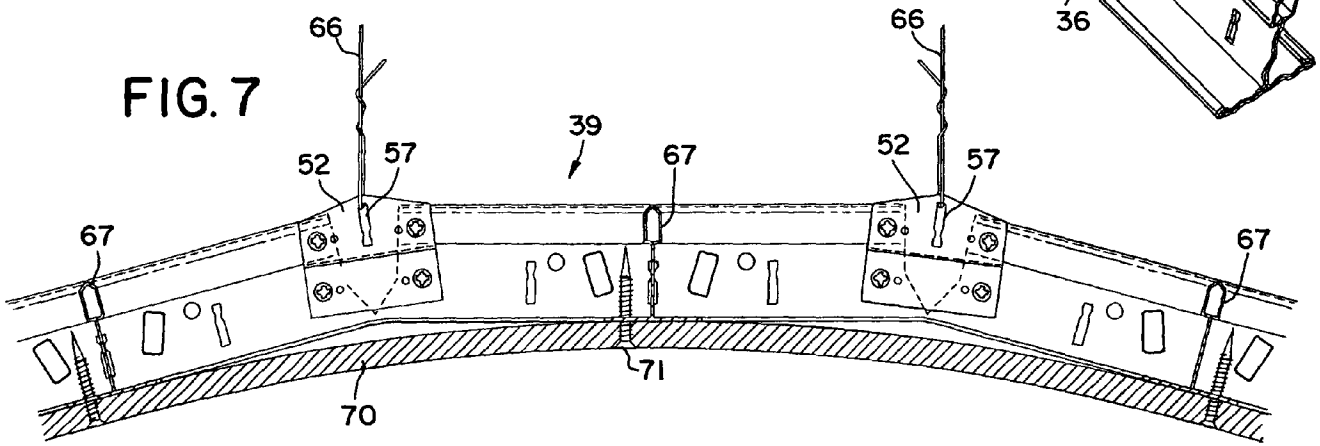
FIG. 7 is a side elevational view similar to FIG. 5, showing a curved ceiling where a concave curved main beam is used, and with the splice plates of the invention in place on the beam.

The beams 20 of the invention are intended for use as main beams in a suspended curved drywall ceiling having concave, or convex, curves as viewed from below.

Where the beams 20 are intended for a convex curve in the ceiling, as viewed from below, as seen in FIG. 5, selected cutouts 30 along the beam 20, are cut at the job site by simply slitting across bulb segment 34, for instance, as seen in FIG. 3, with shears. The beam 20 is then bent at 36, to form, the beams 37 or 39 of the present invention, as seen in FIGS. 5 and 7. There is little resistance to such bend at 36, and because of the cutout 30 shape, the bend at 36 occurs directly below the apex 38 of the V 33, along a bend line transverse to the beam 20 length.

In the prior art curved main beam 26 shown in FIG. 1, splice plates 27 are screwed into the beam 26 to fix the bend 36.

The above construction is disclosed in more detail in the '850 application.

In the present invention, splice plate 50, as shown in the drawings, replaces splice plate 27 as seen in FIG. 1, as is disclosed in the '922 patent.

The splice plate 50 of the invention, as seen in FIG. 2, is used to fix the curve of the main beam in both a convex curved main beam 37 and a concave curved main beam 39. Plate 50 is divided into a portion 51 and a portion 52 by step 53. Portion 51 is rectangular in shape, having a dimension of, for instance, 2.0 inches wide, and 0.790 inches high. Portion 52 has the same width as portion 51, and has a symmetrical angular portion 55 with an apex angle of 180°. Portion 52 has a height dimension of 0.875 inches from step 53 to the apex 56.

A slot 57 extends as shown centrally and vertically in portion 52. Such slot is of the type shown in U.S. Pat. No. 6,178,712, incorporated herein by reference, and is intended to receive the connectors on the end of the cross beams to form a grid, as is well-known in the prior art.

Holes 61, having, for instance, a diameter of 0.125 inches extend through the plate 50 at the locations shown.

Where a convex curved main beam 37 is desired, the splice plate 50 is applied to the bent convex curved main beam 37 at the bends 36, with the angled portion 52 of the plate 50 positioned at the bottom and against the web 22, and the upper portion 51 against the bulb 21 of beam 20, as seen in FIGS. 3, 4, and 5. The step 53 of the plate 50 is of a dimension that provides such fit, for instance, 0.10 inches. The plate 50 is arranged so that the slot 57 is in line with the opening 58 that remains when the straight beam 20 is bent into convex form to form convex curved main beam 37.

The plate 50 is attached to convex curved main beam 37 with self-tapping screws 60 that extend through holes 61 and 62 into the web 22 and the bulb 21 of the beam 37 as seen in FIGS. 4 and 5.

The convex curved main beam 37 is then suspended from a structural ceiling by suspension wires 66 through holes 64 in the beam, in the well-known prior art manner.

Cross beams 67 are secured to the convex curved beam 37, which acts as a main beam of the grid. Connectors on the end of the cross beams 67 are stabbed through slot 57 to secure opposing cross beams to each other and to the curved beam 37, in the well-known prior art manner. Such an arrangement is shown in the '712 patent referred to above.

In inserting the cross beams 67 into the slot 57 of plate 50, it may be necessary to slightly bend the flanges of the a cross beam 67 at the ends thereof to conform to the apex angle of the convex curved main beam 37 to avoid interference from the flanges 23 and 25 when the cross beams 67 are inserted, as shown at 68 in FIG. 5. This can be readily done at the job site with pliers.

Drywall boards 70 are then attached to the grid, as seen in FIG. 5. In applying the drywall 70 to the grid, the faces of the drywall board are wetted, and the board 70 is curved to the desired shape to conform to the curved grid, prior to attachment to the grid. As seen in FIG. 5, the curved drywall 70 will come into contact with the curved grid along cross beams 67, which extend between the convex curved main beams 37 at the bends 36 which are fixed by the splice plate 50. Self-tapping screws 71 extend through the drywall 70 into the cross beam 67, in the well-known prior art manner.

Figure 6:
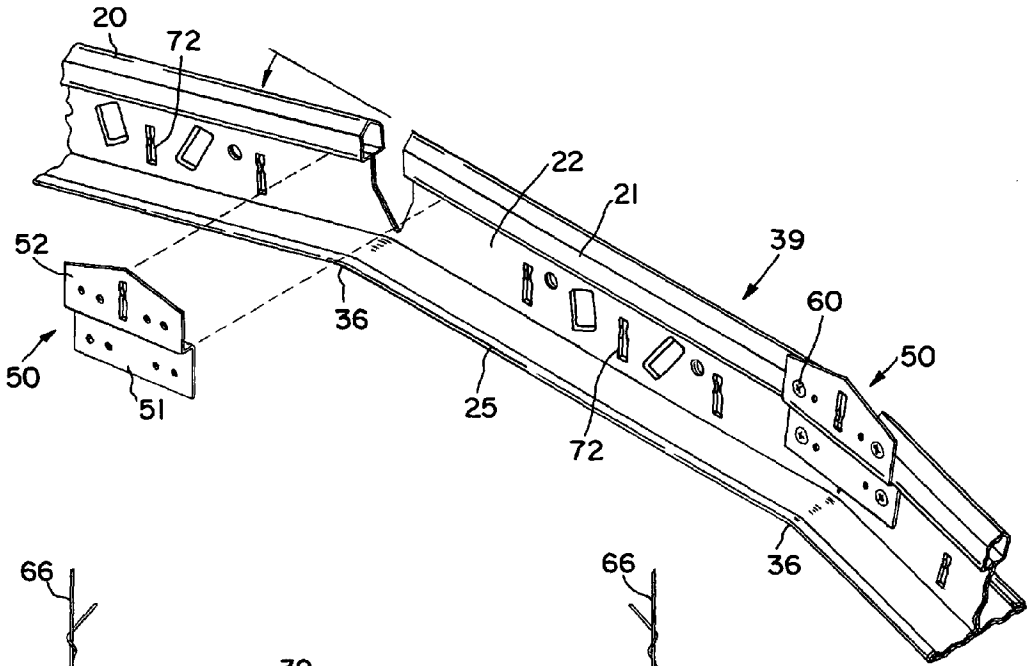
FIG. 6 is a perspective view of a concave curved beam, with a splice plate in place, and one about to be attached.

To use the splice plate 50 of the invention in a concave curved main beam 39, the splice plate 50 is inverted, and applied to the beam 39 as shown in FIGS. 6 and 7. The curved beam is supported by wires 66 that extend from slot 57 in the inverted splice plate.

Cross beams 67 are inserted into the curved main beam 39 in slots 72 in the web 22 at the middle of the chords of each facet of the beam 39, since it is at this location that the curved drywall boards 70 will come into contact with the grid, as seen in FIG. 7. Self-tapping screws 71 secure the drywall board 70 to the cross beams 67 to form a concave curved drywall ceiling.

What is claimed is:

1. In a faceted curved main beam in the form of a convex curved beam (37) or a concave curved beam (39), that is installed in a ceiling grid of a curved suspended drywall ceiling having curved drywall board (70) secured to the grid;

the grid having cross beams (67) connected to the faceted curved main beam (37,39);

the improvement comprising a splice plate (50) secured in the faceted curved main beam (37,39) at a bend (36) that forms a facet of the beam (37,39) and having two integral portions (51,52) connected by a step (53) with a slot (57) in one of the portions (52), wherein a) with the plate (50) secured in a first position at a bend (36) in a convex curved beam (37), the convex curved beam (37) receives a connector on a cross beam (67) in the slot (57), so that a cross beam is positioned where the curved drywall board (70) contacts the grid, whereby the curved drywall board (70) is attached directly to the cross beam (67); and b) with the plate (50) secured in a second position at a bend (36) in a concave curved main beam (39), the concave curved beam (39)

1) is suspended by a hang wire (66) secured to a structural ceiling and to the slot (57) in plate (50), and 2) receives connector on the cross beam (67) in a slot (72) in the concave curved main beam (39) at a position wherein the curved drywall board (70) contacts the grid whereby the curved drywall board (70) is attached directly to the cross beam (67).

2. The improvement of claim 1, wherein the flanges of the cross beam (67) are bent to conform to an apex angle of the convex curved main beam (3) to avoid interference with the flanges (23,25) of convex curved main beam (37).

* * * * *

UNITED STATES PATENT AND TRADEMARK OFFICE

CERTIFICATE OF CORRECTION

PATENT NO. : 6,957,517 B2
DATED : October 25, 2005
INVENTOR(S) : Joseph Auriemma It is certified that error appears in the above-identified patent and that said Letters Patent is hereby corrected as shown below:

Column 6,
Line 15, after "beam" delete "(3)" and insert -- (37) --.

Signed and Sealed this

Third Day of January, 2006

JON W. DUDAS
*Director of the United States Patent and Trademark Office*